US008579025B2

(12) United States Patent
Holderman et al.

(10) Patent No.: US 8,579,025 B2
(45) **Date of Patent: *Nov. 12, 2013**

(54) CONTROL SCREEN ASSEMBLY

(75) Inventors: Luke W. Holderman, Plano, TX (US); Andrew Penno, Morlaas (FR); Jean-Marc Lopez, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/564,264

(22) Filed: Aug. 1, 2012

(65) Prior Publication Data

US 2012/0298352 A1 Nov. 29, 2012

Related U.S. Application Data

(63) Continuation of application No. 12/539,749, filed on Aug. 12, 2009, now Pat. No. 8,256,510.

(51) Int. Cl.
*E21B 43/08* (2006.01)

(52) U.S. Cl.
USPC ..... 166/227; 166/236

(58) Field of Classification Search
USPC ..... 166/227–236
See application file for complete search history.

(56) References Cited

U.S. PATENT DOCUMENTS 6,173,788 B1 1/2001 Lembcke
6,543,545 B1 4/2003 Chatterji et al.
6,571,871 B2 6/2003 Lauritzen et al.
6,719,064 B2 4/2004 Price-Smith et al.
6,868,907 B2 3/2005 Homstvedt et al.
7,013,979 B2 3/2006 Richard
7,284,603 B2 10/2007 Ohmer (Continued)

FOREIGN PATENT DOCUMENTS

GB 2421527 6/2006
GB 2448298 10/2008

(Continued)

OTHER PUBLICATIONS

U.S. Appl. No. 12/201,468, filed Aug. 29, 2008 (now issued 7,814,793).

(Continued)

*Primary Examiner* — Kenneth L Thompson
(74) *Attorney, Agent, or Firm* — Kilpatrick Townsend & Stockton LLP

(57) ABSTRACT

Screen assemblies capable of being disposed in a bore for hydrocarbon fluid production are described. The screen assemblies can support filter mediums and reduce or eliminate plugging by swellable material. One screen assembly includes filter mediums supported by a rigid member located exterior to a portion of a base pipe. The rigid member can include openings through which the filter mediums can be in fluid communication with an inner diameter of the base pipe. Swellable material can be disposed exterior to a second portion of the base pipe adjacent to the rigid member. The filter mediums can be displaced to contact a wellbore and the rigid members can help reduce or prevent plugging of screen assembly openings.

19 Claims, 8 Drawing Sheets

(56) References Cited

U.S. PATENT DOCUMENTS

| | | | | |
|---|---|---|---|---|
| 7,318,481 | B2 | 1/2008 | Richard | |
| 7,814,973 | B2 | 10/2010 | Dusterhoft et al. | |
| 7,841,409 | B2 | 11/2010 | Gano et al. | |
| 7,866,383 | B2 | 1/2011 | Dusterhoft et al. | |
| 8,256,510 | B2 * | 9/2012 | Holderman et al. | 166/227 |
| 2004/0035590 | A1 | 2/2004 | Richard | |
| 2007/0056735 | A1 | 3/2007 | Bosma et al. | |
| 2008/0041577 | A1 | 2/2008 | Baaijens et al. | |
| 2008/0283240 | A1 | 11/2008 | Baaijens et al. | |
| 2009/0008092 | A1 | 1/2009 | Haeberle et al. | |
| 2009/0084559 | A1 | 4/2009 | Freyer | |
| 2009/0173490 | A1 | 7/2009 | Dusterhoft et al. | |
| 2011/0036565 | A1 | 2/2011 | Holderman | |
| 2011/0036567 | A1 | 2/2011 | Holderman et al. | |
| 2011/0042096 | A1 | 2/2011 | Nutley et al. | |

FOREIGN PATENT DOCUMENTS

| | | |
|---|---|---|
| WO | 96/26350 | 8/1996 |
| WO | 2006003112 | 1/2006 |
| WO | 2008/122809 | 10/2008 |
| WO | 2009001073 | 12/2008 |
| WO | 2010025152 | 3/2010 |

OTHER PUBLICATIONS

U.S. Appl. No. 12/201,655, filed Aug. 29, 2008 (now issued 7,666,383).

U.S. Appl. No. 12/201,776, filed Aug. 29, 2008 (now issued 7,841,409).

U.S. Appl. No. 12/539,754, filed Aug. 12, 2009 (now published 20110036567).

U.S. Appl. No. 12/539,749, Non-Final Office Action mailed Dec. 7, 2011 (8 pages).

U.S. Appl. No. 12/539,749, Response to Non-Final Office Action filed Feb. 10, 2012 (15 pages).

U.S. Appl. No. 12/539,749, Final Office Action mailed Apr. 23, 2012 (8 pages).

U.S. Appl. No. 12/539,749, Response to Final Office Action filed May 15, 2012 (10 pages).

U.S. Appl. No. 12/539,749, Advisory Action mailed May 25, 2012 (3 pages).

U.S. Appl. No. 12/539,749, Response to Advisory Action filed Jun. 11, 201 (13 pages).

U.S. Appl. No. 12/539,749, Notice of Allowance mailed Jun. 21, 2012 (5 pages).

* cited by examiner

CONTROL SCREEN ASSEMBLY

CROSS-REFERENCE TO RELATED APPLICATIONS

This application is a continuation of U.S. patent application Ser. No. 12/539,749, titled "Control Screen Assembly," and filed Aug. 12, 2009, allowed, which is incorporated herein by reference in its entirety.

TECHNICAL FIELD OF THE INVENTION

The present invention relates generally to control screens for subterranean fluid production and, more particularly (although not necessarily exclusively), to a control screen assembly having a rigid member that includes an opening providing fluid communication between a filter medium and an internal flow path of a base pipe.

BACKGROUND

Hydrocarbons can be produced through a wellbore traversing a subterranean formation. In some cases, the formation may be unconsolidated or loosely consolidated. Particulate materials, such as sand, from these types of formations may be produced together with the hydrocarbons. Production of particulate materials presents numerous problems. Examples of problems include particulate materials being produced at the surface, causing abrasive wear to components within a production assembly, partially or fully clogging a production interval, and causing damage to production assemblies by collapsing onto part or all of the production assemblies.

Gravel packing the well adjacent to the production interval can assist in stabilizing the formation surrounding the production interval and in filtering particulate materials before the particulate materials enter the production pipe. Gravel packing can include lowering a sand control screen into the wellbore on a work string to a position proximate a selected production interval. A fluid slurry, including a liquid carrier and a material such as gravel, is pumped down the work string and into the well annulus formed between the sand control screen and a perforated well casing or open hole production zone. The gravel is deposited in the well annulus to form a gravel pack. The gravel pack is highly permeable to hydrocarbon fluids, but can block particulate material carried in the hydrocarbon fluids. The gravel pack and sand control screen can also stabilize the formation surrounding the production interval to prevent formation collapses.

Complete gravel packing at a selected production interval can be difficult to achieve due to the formation of sand bridges and other complications experienced when pumping the fluid slurry down the work string. Expandable sand control screens can be used in place of gravel packs that may be less problematic to locate in the wellbore and may provide similar filtering and formation stability as gravel packs.

One expandable sand control screen is a control screen assembly that includes a swellable material, such as a high-swelling rubber, and a filter device on the exterior of the swellable material. The swellable material can be located proximate the production interval and, when activated by a fluid, expand to displace the filter device to the wellbore. The assembly includes openings through which hydrocarbon fluids are directed by the filter device into a base pipe. A telescoping piston can be located in the opening and can support the filter device as the swellable material expands. This type of expandable sand control screen can be effective in filtering and providing formation stability.

In some applications, however, the swellable material may swell into the openings or otherwise swell to block, partially or completely, fluid communication between the interior and exterior of a base pipe. Blocking fluid communication may result in the swellable material partially or completely plugging the opening to the base pipe. A rework of the control screen assembly may be required to alleviate the plugging. Reworks cost substantial time and money because they require suspension of hydrocarbon production for a measurable amount of time and require duplication of work in locating the control screen assembly in the wellbore.

Therefore, screen assemblies that can provide radial support to formations and reduce or eliminate plugging are desirable. Screen assemblies that eliminate or reduce reworks are desirable.

SUMMARY

Certain embodiments of the present invention are directed to screen assemblies that can filter particulate materials in hydrocarbon fluids from a hydrocarbon-bearing subterranean formation and reduce or eliminate plugging. Reducing or eliminating plugging can reduce or eliminate a need for reworks. The screen assemblies may include a swellable material without requiring an opening to be created in the swellable material. Certain screen assemblies can provide stability to a wellbore traversing a subterranean formation.

In one aspect, a screen assembly that can be disposed in a bore is provided. The screen assembly includes a base pipe, a rigid member, a swellable material, and a filter medium. The base pipe includes a sidewall portion with an opening. The rigid member is disposed exterior to a first portion of the base pipe. The rigid member includes an opening in fluid communication with the opening of the base pipe. The swellable material is disposed exterior to a second portion of the base pipe. The filter medium is at least partially disposed exterior to the swellable material and is in fluid communication with the opening of the rigid member. In response to contact with an activating fluid, the swellable material can expand and displace at least part of the filter medium toward a surface of the bore.

In at least one embodiment, the screen assembly includes a piston disposed in the opening of the rigid member and coupled to the base pipe. The piston includes a telescoping portion coupled to the filter medium. The telescoping portion can radially extend from the opening of the rigid member when the swellable material expands. The filter medium can filter fluids and direct the fluids to an internal flow path of the base pipe through the piston.

In at least one embodiment, the screen assembly includes a material between the filter medium and the rigid member. The material includes at least one of a non-swelling media or a low-swelling media. The material can provide a temporary seal between the filter medium and the rigid member. In some embodiments, the material includes rubber.

In at least one embodiment, the activating fluid to which the swellable material is responsive includes at least one of a hydrocarbon fluid, water, or a gas.

In at least one embodiment, the filter medium has a cross-sectional shape of at least one of a kidney shape, an oval, a circle, or a rectangle.

In at least one embodiment, the rigid member is a ring that is at least one of a metal, a composite polymer, or a non-swelling rubber compound.

In another aspect, a screen assembly that can be disposed in a bore is provided. The screen assembly includes a base pipe, a rigid member, a swellable material, and a plurality of filter mediums. The base pipe includes a sidewall portion that has a plurality of openings. The rigid member is disposed exterior to a first portion of the base pipe and includes a plurality of openings. Each opening of the plurality of openings of the rigid member is in fluid communication with an opening of the plurality of openings of the sidewall portion. The swellable material is disposed exterior to a second portion of the base pipe. The plurality of filter mediums are at least partially disposed exterior to the swellable material. Each of the plurality of filter mediums is in fluid communication with at least one of the plurality of openings of the rigid member. In response to contact with an activating fluid, the swellable material can expand and displace at least part of each of the plurality of filter mediums toward a surface of the bore.

In another aspect, a screen assembly that can be disposed in a bore is provided. The screen assembly includes a base pipe, a first rigid member, a second rigid member, a swellable material, and a plurality of filter mediums. The base pipe includes a sidewall portion with a first plurality of openings and a second plurality of openings. The first plurality of openings are located at a first portion of the base pipe. The second plurality of openings are located at a second portion of the base pipe. The first rigid member is disposed exterior to the first portion of the base pipe. The second rigid member is disposed exterior to the second portion of the base pipe. The swellable material is disposed exterior to a third portion of the base pipe. The plurality of filter mediums are at least partially disposed exterior to the swellable material. Each of the plurality of filter mediums is in fluid communication with at least one opening of the first plurality of openings or the second plurality of openings. In response to contact with an activating fluid, the swellable material can expand and displace at least part of each of the plurality of filter mediums toward a surface of the bore.

In at least one embodiment, the third portion of the base pipe is located between the first portion and the second portion.

In at least one embodiment, each of the plurality of filter mediums is in fluid communication with at least one opening of the first plurality of openings or the second plurality of openings through at least one of a plurality of openings of the first rigid member or the second rigid member.

In at least one embodiment, each of the first rigid member and the second rigid member includes a first receiving portion and a second receiving portion. The first receiving portion can support a first filter medium of the plurality of filter mediums in a running configuration. The second receiving portion can support a second filter medium of the plurality of filter mediums in the running configuration. In some embodiments, the first receiving portion and the second receiving portion define grooves for supporting the first filter medium and the second filter medium of the plurality of filter mediums in the running configuration. In some embodiments, the second rigid member is rotated forty-five degrees relative to the first rigid member and the first receiving portion of the first rigid member is aligned with the second receiving portion of the second rigid member.

These illustrative aspects and embodiments are mentioned not to limit or define the invention, but to provide examples to aid understanding of the inventive concepts disclosed in this application. Other aspects, advantages, and features of the present invention will become apparent after review of the entire application.

DETAILED DESCRIPTION

Certain aspects and embodiments of the present invention relate to screen assemblies capable of being disposed in a bore, such as a wellbore, of a subterranean formation for use in producing hydrocarbon fluids from the formation. The screen assemblies may be configured to support filter mediums and reduce or eliminate plugging by swellable material. A screen assembly according to some embodiments includes filter mediums supported by a rigid member located exterior to part of a base pipe. The rigid member can include openings through which the filter mediums can be in fluid communication with an inner diameter of the base pipe. Swellable material can be disposed exterior to a second part of the base pipe and adjacent to the rigid member. The filter mediums can be displaced by the swellable material to contact a wall of the bore and the rigid members can help reduce or prevent plugging of screen assembly openings. In some embodiments, the screen assembly is a sand control screen assembly that can reduce or prevent production of particulate materials from a well that traverses a hydrocarbon bearing subterranean formation or operates as an injection well.

Figure 1A:
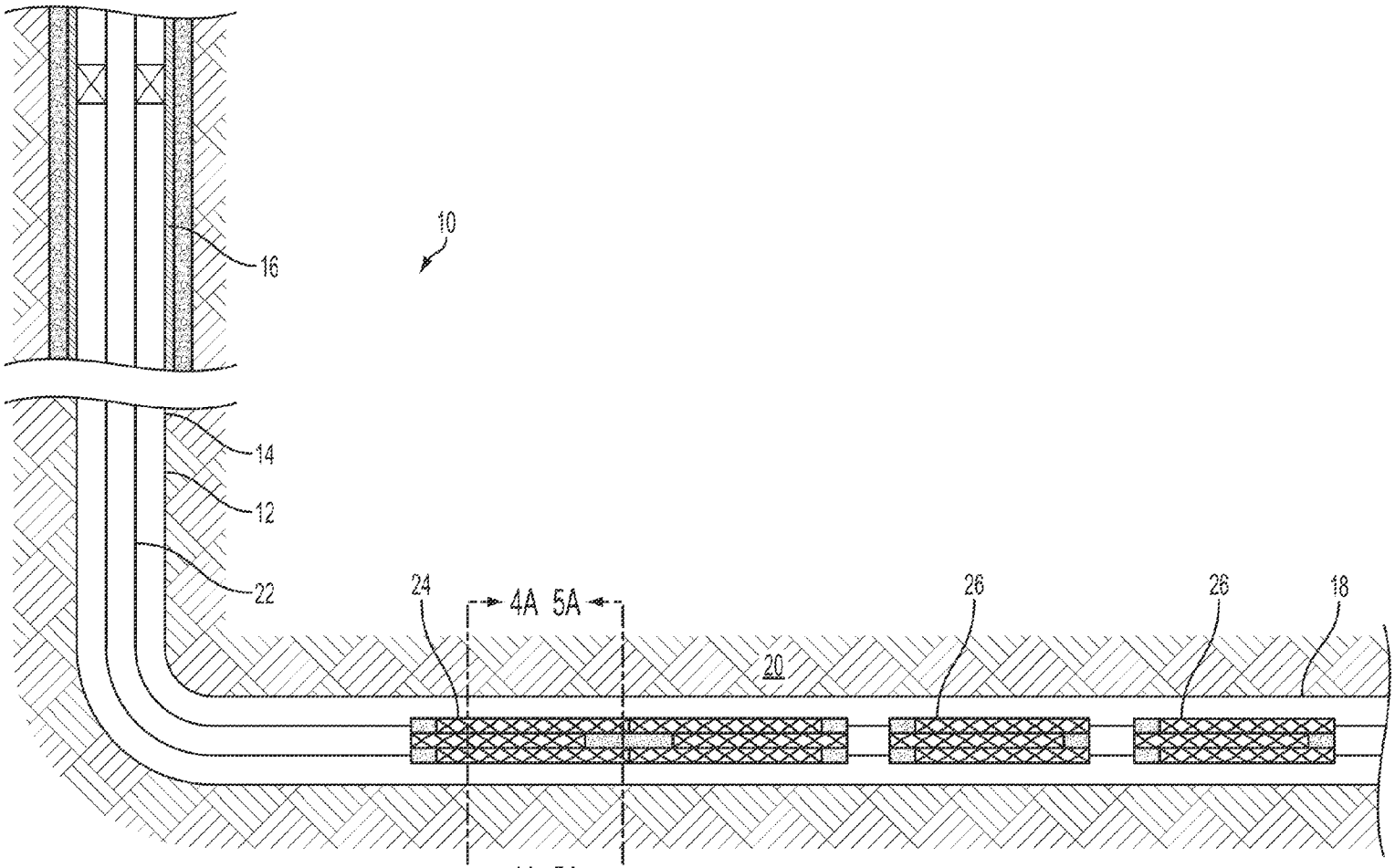
FIG. 1A is a schematic illustration of a well system having screen assemblies in a running configuration according to one embodiment of the present invention.

FIG. 1A shows a well system 10 with screen assemblies according to certain embodiments of the present invention. The well system 10 includes a bore that is a wellbore 12 that extends through various earth strata. The wellbore 12 has a substantially vertical section 14 and a substantially horizontal section 18. The substantially vertical section 14 includes a casing string 16 cemented at an upper portion of the substantially vertical section 14. The substantially horizontal section 18 is open hole and extends through a hydrocarbon bearing subterranean formation 20.

A tubing string 22 extends from the surface within wellbore 12. The tubing string 22 can provide a conduit for formation fluids to travel from the substantially horizontal section 18 to the surface. Screen assemblies 24, 26 are positioned with the tubing string 22 in the substantially horizontal section 18. The screen assemblies 24, 26 are shown in a running or unextended configuration. In some embodiments, screen assemblies 24, 26 are sand control screen assemblies that can filter particulate materials from hydrocarbon fluids, direct the hydrocarbon fluids to an inner diameter of the tubing string 22, and stabilize the formation 20.

Figure 1B:
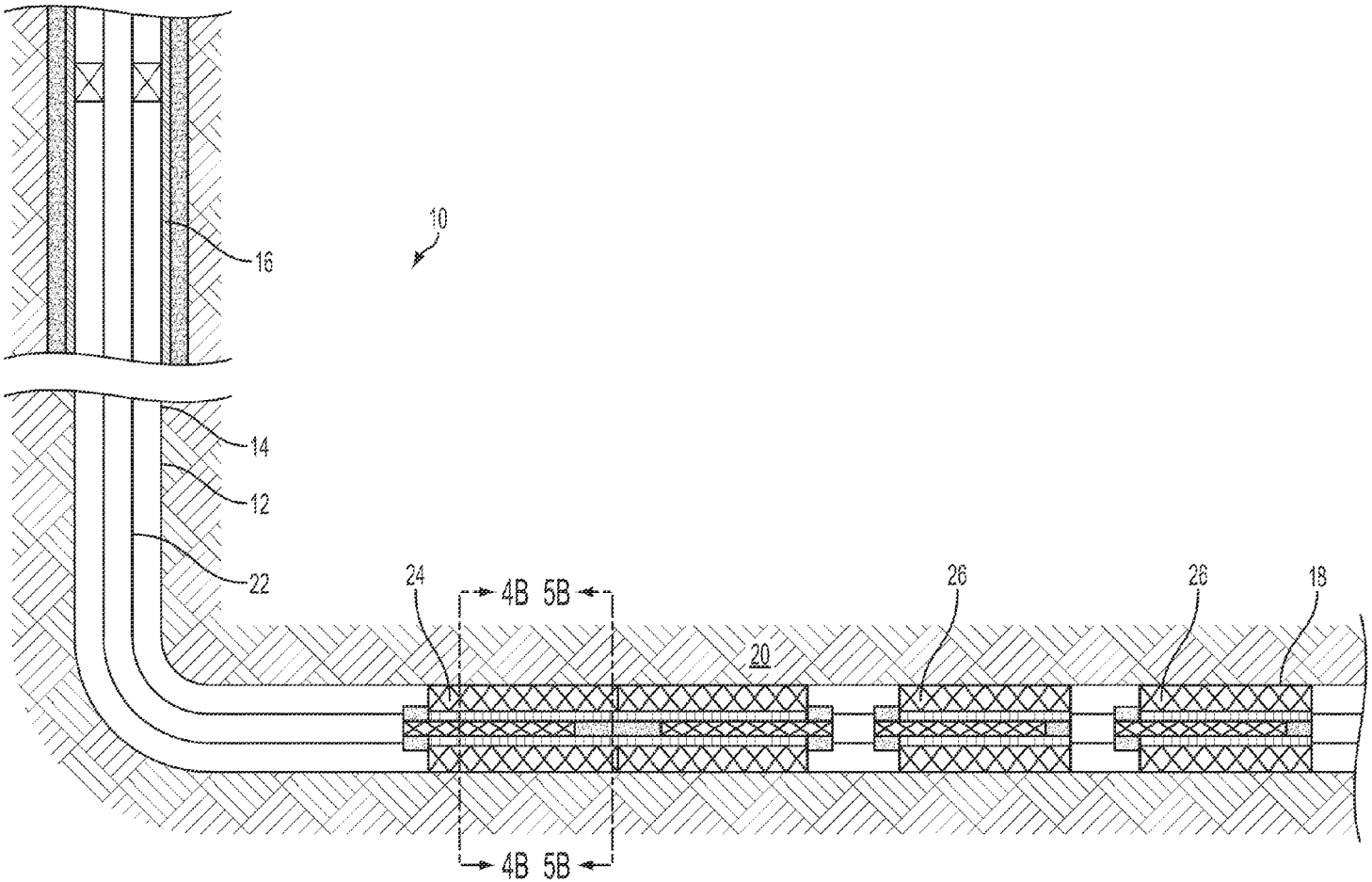
FIG. 1B is a schematic illustration of a well system having screen assemblies in an operating configuration according to one embodiment of the present invention.

FIG. 1B shows the well system 10 with screen assemblies 24, 26 in an operating or a radially expanded configuration. Each of the screen assemblies 24, 26 can include a base pipe, a rigid member, swellable material, and filter mediums. The rigid member may be a ring made from a metal, composite polymer, non-swelling rubber compound, or the like and may be disposed exterior to part of the base pipe. Examples of metals from which the rigid member may be made include steel, iron, brass, copper, bronze, tungsten, titanium, cobalt, nickel, and a combination of these or other types of materials. The swellable material may be a relatively high swelling rubber or polymer and may be disposed exterior to another part of the base pipe. The filter mediums may be coupled to the exterior of the swellable material and supported by part of the rigid member at least in a running configuration.

When an activating fluid contacts the screen assemblies 24, 26, the swellable material of each of the screen assemblies can expand. Expansion of the swellable material can displace filter mediums of the screen assemblies 24, 26 to contact a surface of wellbore 12. The activating fluid may be any fluid to which the swellable material responds by expanding. Examples of activating fluid include hydrocarbon fluids, water, and gas.

Screen assembly 24 may be a screen assembly that includes filter mediums that are laterally and longitudinally adjacent to each other. Screen assemblies 26 may be screen assemblies that include filter mediums that are only laterally adjacent to each other.

FIGS. 1A and 1B show tubing string 22 with screen assemblies 24, 26. Tubing strings according to various embodiments of the present invention, however, may include any number of other tools and systems in addition to screen assemblies 24, 26. Examples of other tools and systems include fluid flow control devices, communication systems, and safety systems. Tubing string 22 may also be divided into intervals using zonal isolation devices such as packers. Zonal isolation devices may be made from materials that can expand upon contact with a fluid, such hydrocarbon fluids, water, and gas.

In addition, FIGS. 1A and 1B show screen assemblies according to certain embodiments of the present invention in the substantially horizontal section 18 of the wellbore 12. Various screen assembly embodiments according to the present invention, however, can be used in deviated, vertical, or multilateral wellbores. Deviated wellbores may include directions different than, or in addition to, a general horizontal or a general vertical direction. Multilateral wellbores can include a main wellbore and one or more branch wellbores. Directional descriptions are used herein to describe the illustrative embodiments but, like the illustrative embodiments, should not be used to limit the present invention.

As stated above, certain embodiments of the present invention can be disposed in an injection well. In an injection well, water or other fluid is injected into the well to increase flow of hydrocarbon fluids to a nearby production well. Screen assemblies according to certain embodiments of the present invention can be disposed in the injection well to provide support during and after the fluid injection process. In some embodiments, injected fluid exits a base pipe through openings in the base pipe, in a rigid member and in a filter medium supported by the rigid member. The filter medium may be a support member that does not include filtration material, but includes structure capable of supporting a formation.

Screen assemblies according to some embodiments of the present invention can be disposed in a cased hole completion. In a cased hole completion, a large diameter pipe is positioned between a production string and a formation. The large diameter pipe may be a base pipe with openings in a sidewall portion of the base pipe. A screen assembly can be positioned exterior to the large diameter pipe. The screen assembly can include a rigid member with an opening that is in fluid communication with an opening in the sidewall portion. A filter medium can be supported by the rigid member and can be in fluid communication with the opening in the sidewall portion through the rigid member opening.

Figure 2:
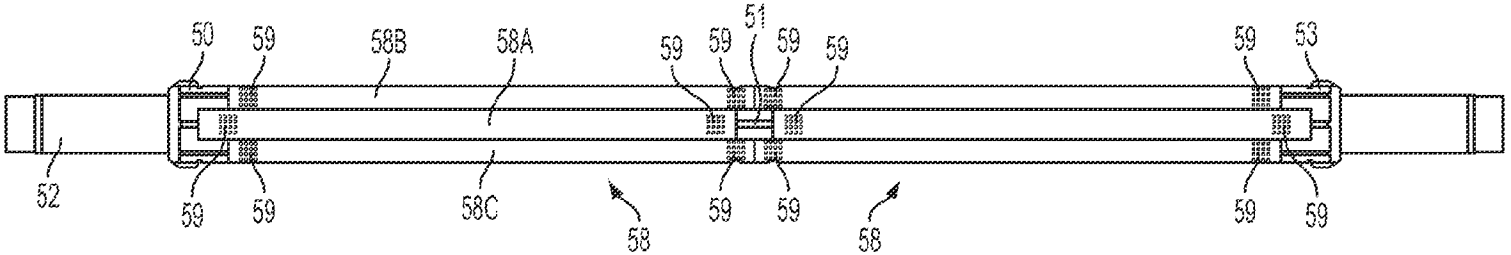
FIG. 2 is a side view of a screen assembly of FIG. 1A in a running configuration according to one embodiment of the present invention.
Figure 3:
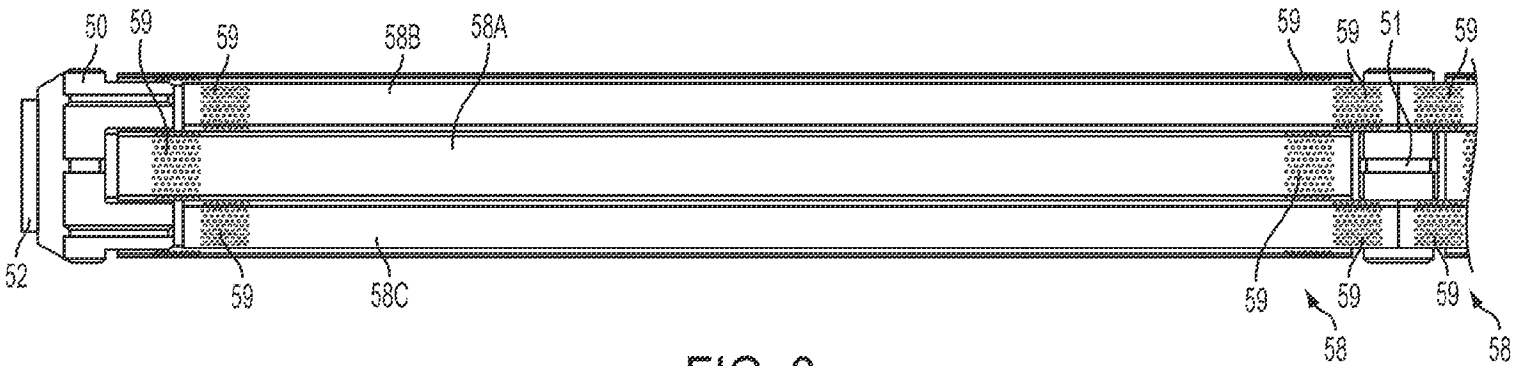
FIG. 3 is a side view of a section of the screen assembly of FIG. 2 in a running configuration.

FIGS. 2 and 3 show a more detailed view of screen assembly 24 in a running configuration. The screen assembly 24 depicted in the figures includes three rigid members 50, 51, 53 located circumferential to a base pipe 52. The rigid members 50, 51, 53 may be coupled to the base pipe. In other embodiments, a base pipe is provided that includes one or more rigid members. Screen assemblies according to various embodiments of the present invention can include any number of rigid members. For example, screen assemblies 26 in FIGS. 1A and 1B include two rigid members. In other embodiments, screen assemblies include one rigid member. Rigid members 50, 51, 53 may be constructed from any material capable of retaining a general shape upon contact with fluids such as hydrocarbon fluids, gas, and water. Examples of material from which rigid members 50, 51, 53 can be constructed include metal such as steel. In some embodiments, rigid members 50, 51, 53 are rings constructed from steel. The rigid members 50, 51, 53 may include openings that are in fluid communication with openings in a sidewall of the base pipe 52. In some embodiments, each of the rigid members 50, 51, 53 includes four openings and each of the four openings is in fluid communication with openings in a sidewall of a base pipe.

Swellable material (not shown) can be disposed circumferential to a second portion of the base pipe 52 and between the rigid members 50, 51, 53. Filter mediums 58 are positioned on an exterior of the swellable material and can be supported by rigid members 50, 51, 53 at least in a running configuration. Each of the filter mediums 58 may be supported by one of the rigid members 50, 51, 53. For example, filter medium 58A is supported by rigid member 50 and filter mediums 58B, 58C is supported by rigid member 51. In some embodiments, each of the filter mediums 58 are supported by being retained, at least temporarily, by one of the rigid members 50, 51, 53. For example, each of the filter mediums 58 can be retained by grooves in one or more rigid members 50, 51, 53 in a running configuration and can be allowed to detach from the grooves in an operating configuration. In other embodiments, each of the filter mediums 58 are retained by the grooves in one or more rigid members 50, 51, 53 in the operating configuration or otherwise supported by a component disposed in one of the rigid members 50, 51, 53, such as a telescoping piston.

The filter mediums 58 may be filtration tubes that extend longitudinally from a rigid member and have a substantially rectangular surface shape. In some embodiments, the filter mediums 58 have a surface shape that resembles, for example, a helicopter blade. Each of the filter mediums 58 can include perforations 59 that allow hydrocarbon fluids to enter the filter mediums 58 for filtration and direction to an inner flow path of the base pipe 52 through openings in one or more of the rigid members 50, 51, 53. In the running configuration shown in FIGS. 2 and 3, the filter mediums 58 are adjacent to each other. The swellable material can be configured to expand and displace the filter mediums 58 radially during an operating configuring. In some embodiments, the filter mediums 58 are separated by swellable material during the operating configuration.

Filter mediums according to some embodiments of the present invention may be or include a control line that can be a fiber optic cable in communication with a sensor capable of contacting a formation. The control line can detect conditions associated with the formation and transmit information about the conditions to the surface for analysis. Filter mediums may also include a fiber optic disposed in housings of the filter mediums to provide condition information in a running configuration or otherwise provide information to protect the filter mediums.

Figure 4A:
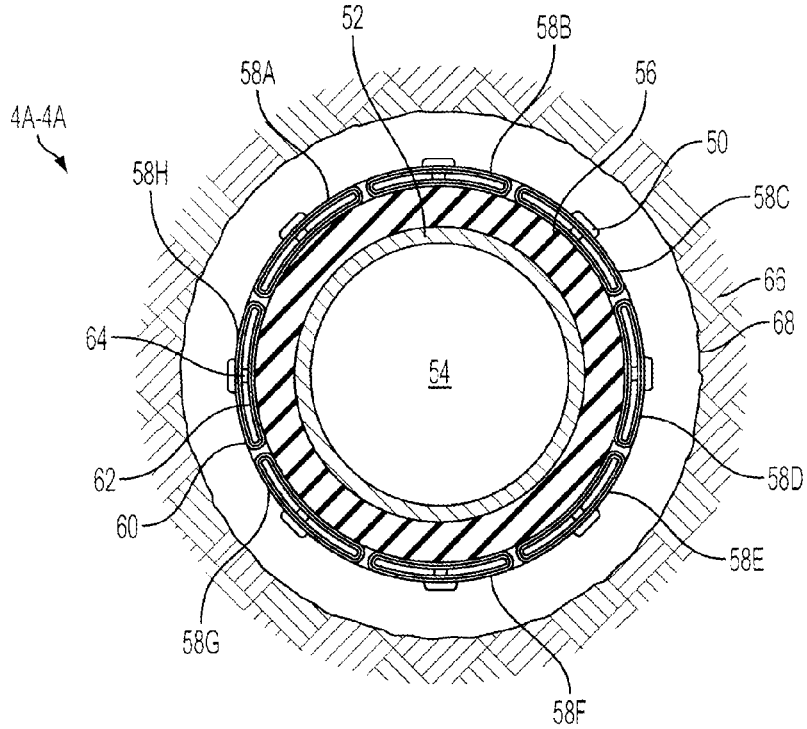
FIG. 4A is a cross sectional view along line 4A-4A of a screen assembly of FIG. 1A in a running configuration according to one embodiment of the present invention.
Figure 4B:
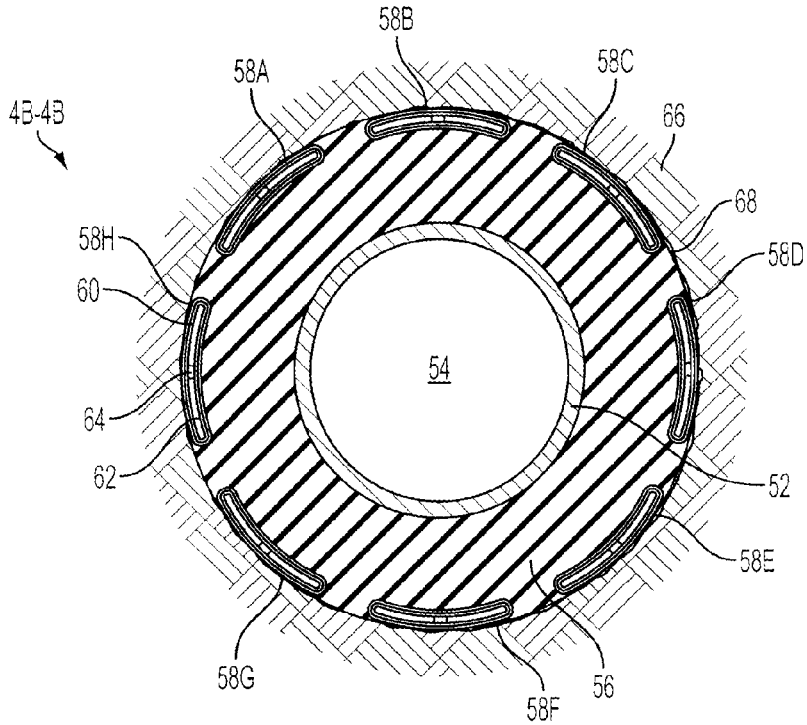
FIG. 4B is a cross sectional view along line 4B-4B of a screen assembly of FIG. 1B in an operating configuration according to one embodiment of the present invention.

FIGS. 4A and 4B show a cross-sectional view of part of the screen assembly 24 from FIGS. 1A (running configuration) and 1B (operating configuration), respectively. FIGS. 4A and 4B show a base pipe 52 that defines an internal flow path 54 through which hydrocarbon fluids, for example, can flow. A swellable material 56 surrounds the base pipe 52. The swellable material 56 can be attached to the base pipe 52, such as by bonding or other suitable technique. Part of a rigid member 50 is shown in FIG. 4A, but it is distant to the cross-section shown in FIG. 4A.

Filter mediums are shown as filter mediums 58A-H and are positioned on an exterior of the swellable material 56. FIG. 4A shows eight filter mediums 58A-H, but screen assemblies according to various embodiments of the present invention can include any number, from one to many, of filter mediums 58A-H. In some embodiments, the filter mediums 58A-H are bonded to the exterior of swellable material 56. For example, a relatively low swelling or non-swelling material can be positioned between the exterior of the swellable material 56 and the filter mediums 58A-H. The filter mediums 58A-H can be bonded to the low swelling or non-swelling material and the low swelling or non-swelling material can be bonded to the swellable material 56. The low swelling or non-swelling material may assist in preventing the swellable material 56 from damaging the filter mediums 58A-H upon expansion.

The swellable material 56 can expand upon contact with an activating fluid and displace the filter mediums 58A-H to contact a formation 66 at an internal diameter of a wellbore 68. In some embodiments, the filter mediums 58A-H are filtration tubes that can filter particulate materials from hydrocarbon fluids and direct the hydrocarbon fluids to openings in the base pipe 52. The filter mediums 58A-H illustrated each include a housing 60 for filter material 62. The filter material 62 can include a filtration opening 64 through which hydrocarbon fluid can be directed to an opening in the base pipe 52. The housing 60 may be made of any suitable material and may be partially perforated to allow hydrocarbon fluids to enter the housing 60. The filter material 62 may be any suitable material, such as a fine mesh, that can filter particulate materials from hydrocarbon fluid.

The filter mediums 58A-H have a kidney-shaped cross-sectional shape. The kidney-shaped cross-section may assist in attaching the filter mediums 58A-H to the swellable material 56 and may result in more surface area of the filter mediums 58A-H, as compared to filter mediums having a different cross-sectional shape, contacting the wellbore 68 upon expansion of the swellable material 56. Filter mediums according to other embodiments of the present invention, however, may have any type of cross-sectional shape. Examples of these types of cross-sectional shapes include an oval, a circle, a rectangle, and a combination of two or more cross-sectional shapes. The filter mediums 58A-H can have a cross-sectional length that is selected based on the particular requirements of a production interval in which the screen assembly 24 is located.

The swellable material 56 can expand upon contact with an activating fluid, as shown in FIG. 4B. The activating fluid can include hydrocarbon fluid, water, or gas. Various techniques can be used to contact the swellable material 56 with an activating fluid. One technique includes configuring the swellable material 56 to expand upon contact with activating fluids already present within the wellbore when the screen assembly 24 is installed or with activating fluids produced by the formation 66 after installation. The swellable material 56 may include a mechanism for delaying swell to prevent swelling during installation. Examples of a mechanism for delaying swell include an absorption delaying layer, coating, membrane, or composition. Another technique includes circulating activating fluid through the well after the screen assembly 24 is installed in the well. In other embodiments, swellable material 56 is capable of expansion upon its location in an environment having a temperature or a pressure that is above a pre-selected threshold in addition or alternative to an activating fluid.

Expansion of the swellable material 56 can displace the filter mediums 58A-H to contact the formation 66 at wellbore 68. The thickness of the swellable material 56 can be optimized based on the diameter of the screen assembly 24 and the diameter of the wellbore 68 to maximize contact area of the filter mediums 58A-H with the wellbore 68 upon expansion. In some embodiments, part of the swellable material 56 expands between the filter mediums 58A-H and contacts the formation 66 at wellbore 68 between the filter mediums 58A-H to conform to non-uniform wellbore diameters. The swelled screen assembly 24 can reduce or eliminate annular flow of hydrocarbon and other fluids, provide multiple flow paths for filtered hydrocarbon fluids, and provide stabilization to the wellbore 68. For example, the swelled screen assembly 24 can support the formation 66 to prevent formation collapse. In some embodiments, the swelled screen assembly 24 can provide an amount of collapse support within a range of 500 psi to 2000 psi.

Figure 5A:
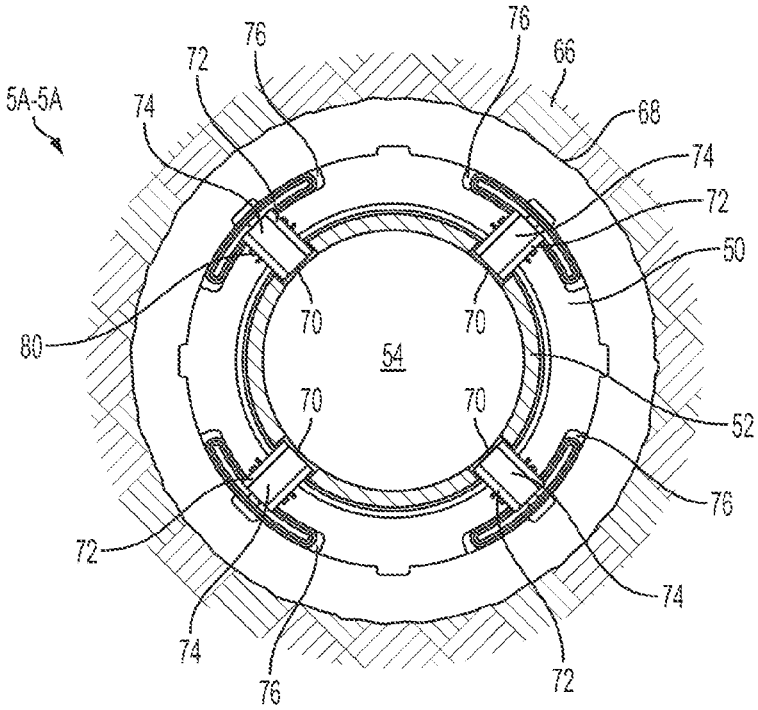
FIG. 5A is a cross sectional view along line 5A-5A of the screen assembly of FIG. 1A in a running configuration according to one embodiment of the present invention.
Figure 5B:
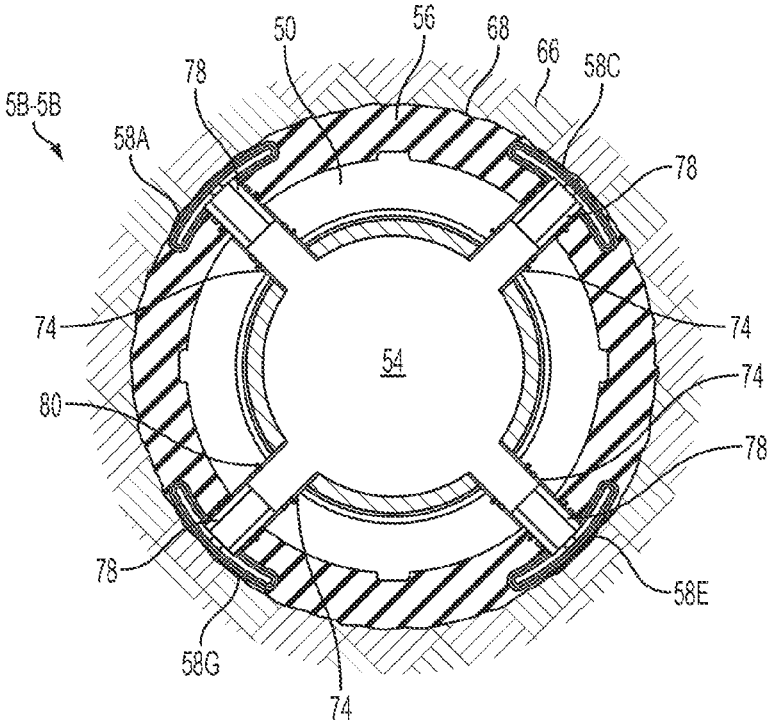
FIG. 5B is a cross sectional view along line 5B-5B of the screen assembly of FIG. 1B in an operating configuration according to one embodiment of the present invention.

Rigid members that support filter mediums according to certain embodiments of the present invention can include pistons disposed in openings of the rigid members. The pistons may be telescoping pistons that can support the filter mediums in a running configuration and an operating configuration. FIGS. 5A and 5B show a cross-sectional view of one of the rigid members 50 of the screen assembly 24 from FIGS. 1A (running configuration) and 1B (operating configuration), respectively. The base pipe 52 includes openings 70 in a sidewall portion of the base pipe 52. The rigid member 50 includes openings 72 that are in fluid communication with the openings 70 of the base pipe 52. Pistons 74 are disposed in the openings 72 and can be coupled to filter mediums. FIGS. 5A and 5B illustrate a rigid member 50 that can support four filter mediums that are designated 58A, 58C, 58E, and 58G. Rigid members according to various embodiments of the present invention, however, can support any number of filter mediums.

The filter mediums 58A, 58C, 58E, 58G can be coupled to a low swelling or non-swelling material 76. The low-swelling or non-swelling material 76 may assist the rigid member 50 in supporting the filter mediums 58A, 58C, 58E, 58G by providing a temporary seal between the filter mediums 58A, 58C, 58E, 58G and rigid member 50. In some embodiments, the low swelling or non-swelling material 76 is a low swelling or non-swelling rubber.

Pistons 74 may each include a telescoping portion 78 that extends radially from the openings 72, as shown in FIG. 5B, when the swellable material 56 expands to displace the filter mediums 58A, 58C, 58E, 58G to contact the wellbore 68 at the formation 66. In some embodiments, grooves 80 in the rigid members 50 circumferential to the pistons 74 can receive O-rings and/or safety catch rings. The O-rings may provide a seal to prevent fluids from traveling between the pistons 74 and the rigid member 50. The safety catch rings may prevent the pistons 74 from exiting the openings 72, such as when the swellable material 56 expands.

FIGS. 5A and 5B show four filter mediums 58A, 58C, 58E, 58G coupled to four pistons 74. Rigid member 51 from FIGS. 2 and 3 can include a similar cross-sectional arrangement of the other four filter mediums 58B, 58D, 58F, 58H shown in FIGS. 4A and 4B. Rigid member 51 can be located a selected longitudinal distance from the cross-section shown in FIGS. 5A and 5B. Rigid member 51 may be rotated forty-five degrees relative to rigid member 50 to allow filter mediums 58A-H to be positioned adjacent to each other.

Figure 6A:
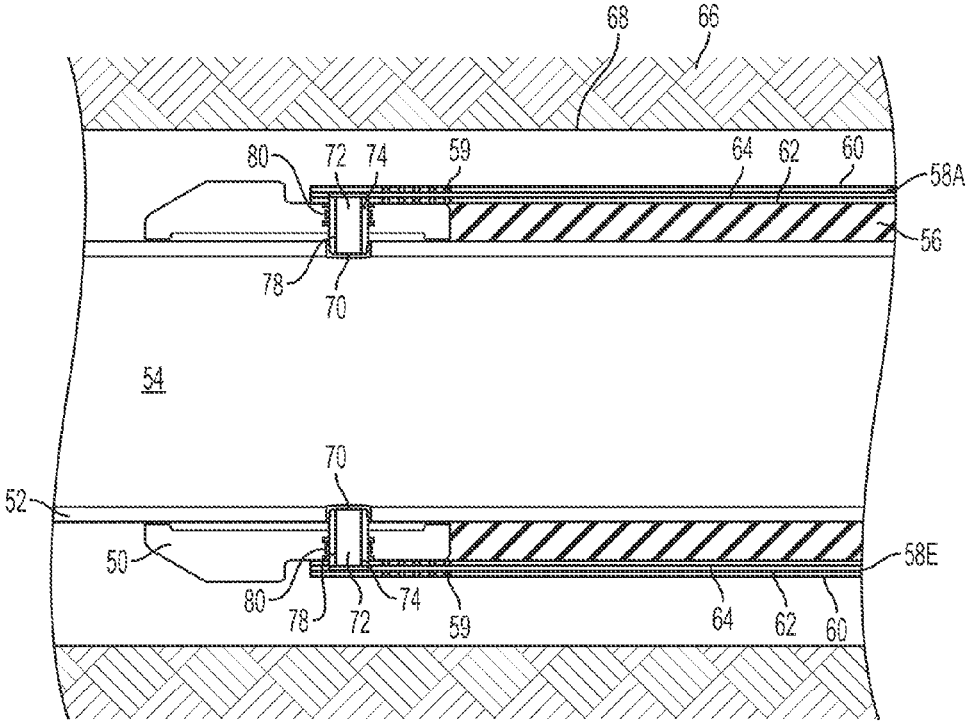
FIG. 6A is a cross sectional view of a screen assembly in a running configuration according to one embodiment of the present invention.
Figure 6B:
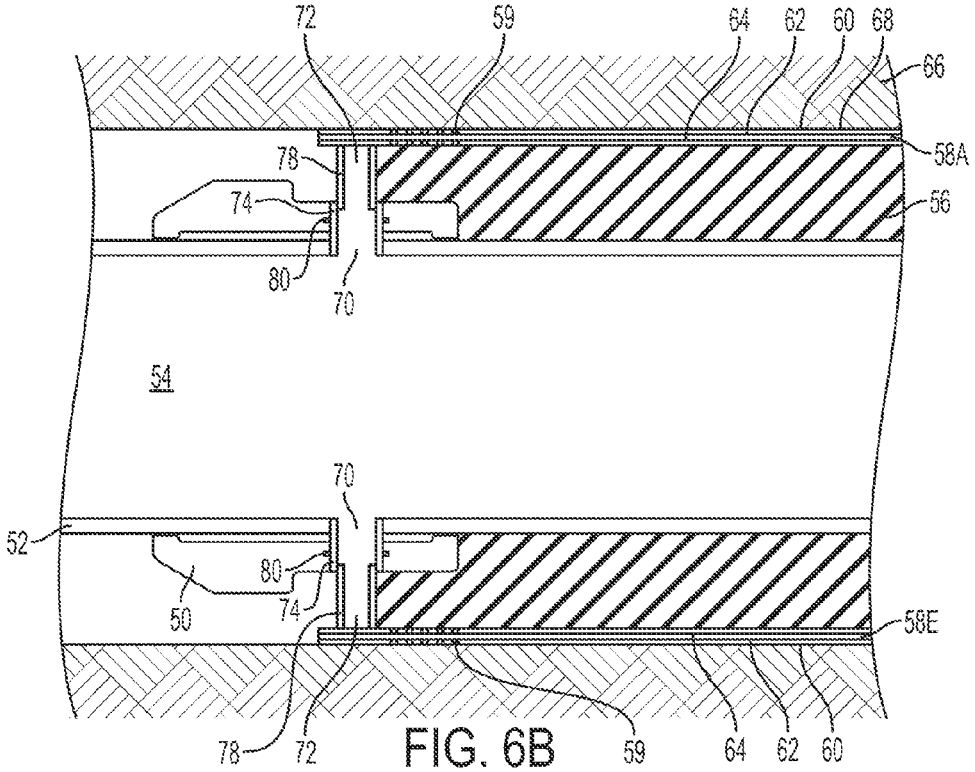
FIG. 6B is a cross sectional view of a screen assembly in an operating configuration according to one embodiment of the present invention.

FIGS. 6A and 6B illustrate cross-sectional side views of one embodiment of the screen assembly 24 disposed in a wellbore 68 in a running configuration and operating configuration, respectively. The screen assembly includes a base pipe 52 that defines an internal flow path 54 through which hydrocarbon fluids can travel. A rigid member 50 is disposed exterior to a first portion of the base pipe 52. The rigid member 50 may be a ring made from a metal, composite polymer, non-swelling rubber, or the like. Examples of metals from which the rigid member may be made include steel, iron, brass, copper, bronze, tungsten, titanium, cobalt, nickel, and a combination of these and other types of materials.

In some embodiments, an interface layer is disposed between the base pipe 52 and at least part of the rigid member 50. The interface layer may bond the rigid member 50 to the base pipe 52. The interface layer may also provide a seal between the rigid member 50 and the base pipe 52 to prevent annular flow of fluids from formation 66.

The base pipe 52 includes openings 70 in a sidewall portion of the base pipe 52. The openings 70 are in fluid communication with filter mediums 58A, 58E through openings 72 in the rigid member 50. The filter mediums 58A, 58E are supported by the rigid member 50 in the running configuration. In each of the openings 72, a piston 74 is disposed. The pistons 74 allow for fluid communication between the filter mediums 58A, 58E and base pipe openings 70.

Swellable material 56 is disposed exterior to a second portion of the base pipe 52 and longitudinally adjacent to the rigid member 50. The swellable material 56 is positioned between the base pipe 52 and part of each of the filter mediums 58A, 58E. The swellable material 56 can retain an initial size during a running configuration and can expand upon contact with an activating fluid in an operating configuration. The swellable material 56 can displace the filter mediums 58A, 58E to contact the wellbore 68 when the swellable material 56 expands in the operating configuration.

The filter mediums 58A, 58E each include a housing 60 for filter material 62. The housing 60 includes perforations 59 through which hydrocarbon fluids produced by the formation 66 can flow to the filter material 62. The filter material 62 can filter particulate materials from the hydrocarbon fluids and direct the filtered hydrocarbon fluids through a filtration opening 64 to the flow path 54 through the base pipe openings 70 and rigid member openings 72.

The pistons 74 can support the filter mediums 58A, 58E in the running configuration and the operating configuration. For example, the pistons 74 may be coupled to the filter mediums 58A, 58E and the pistons 74 can include telescoping portions 78 that can extend radially from the rigid member openings 72 when the swellable material 56 expands and displaces the filter mediums 58A, 58E. The rigid member 50 can isolate openings from the swellable material 56 to reduce or eliminate plugging and/or can allow the screen assembly to be constructed without requiring openings to be included in the swellable material 56.

Figure 7A:
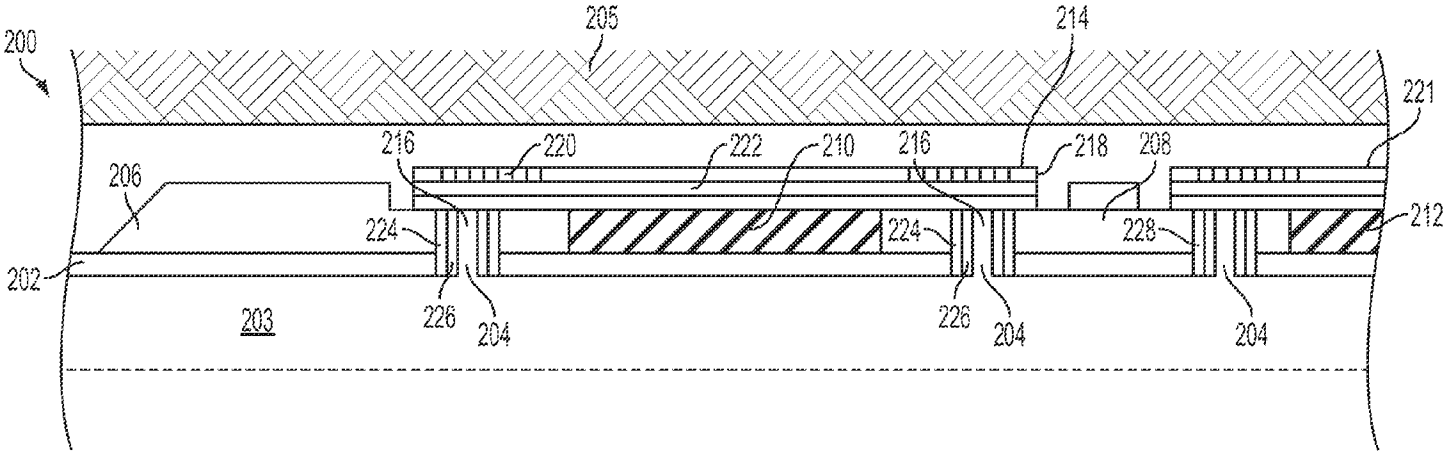
FIG. 7A is a cross sectional view of a second embodiment of a screen assembly in a running configuration according to one embodiment of the present invention.
Figure 7B:
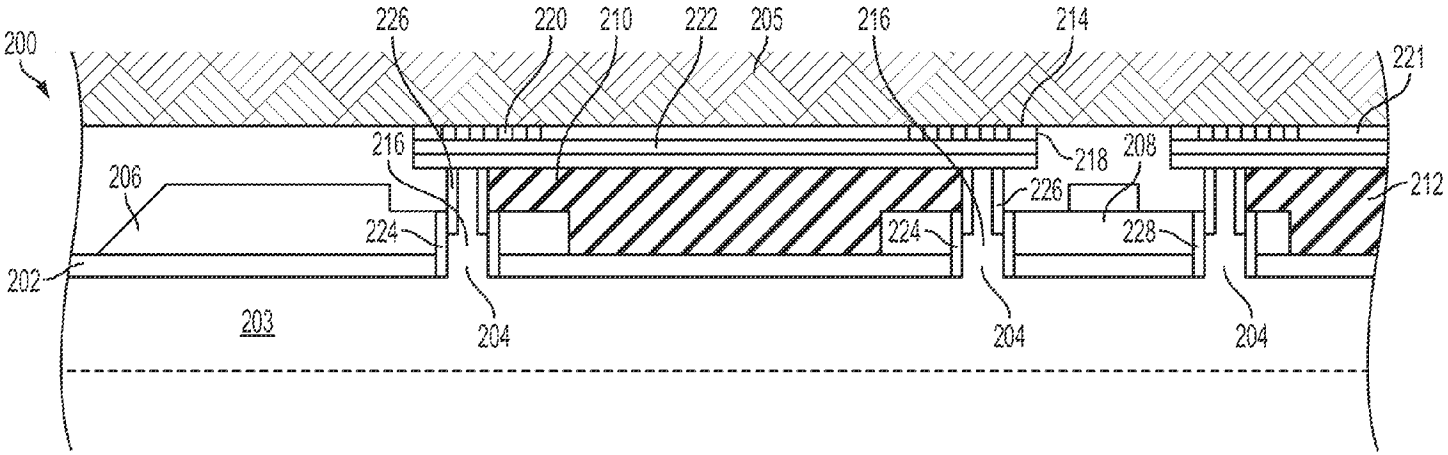
FIG. 7B is a cross sectional view of the second embodiment of the screen assembly of FIG. 7A in an operating configuration according to one embodiment of the present invention.

Screen assemblies according to certain embodiments of the present invention can be constructed using multiple rigid members supporting multiple filter mediums extending longitudinally along an exterior of a base pipe. FIGS. 7A and 7B show a cross-sectional view of part of a screen assembly 200 with multiple rigid members in a running configuration and an operating configuration, respectively.

The screen assembly 200 includes a base pipe 202 that has openings 204 in a sidewall portion of the base pipe 202. The base pipe 202 can define an internal flow path 203 for hydrocarbon fluids produced by a formation 205. A first rigid member 206 is disposed exterior to a first circumferential portion of the base pipe 202. A second rigid member 208 is disposed exterior to a second circumferential portion of the base pipe 202. Swellable material 210 is disposed exterior to a third circumferential portion of the base pipe 202 between the first circumferential portion and the second circumferential portion. Second swellable material 212 may also be disposed exterior to a fourth circumferential portion of the base pipe 202 and longitudinally adjacent to the second rigid member 208.

A filter medium 214 is disposed exterior to the swellable material 210 and of part of the first and second rigid members 206, 208. The filter medium 214 can be in fluid communication with the internal flow path 203 through two base pipe openings 204 and openings 216 in each of the first rigid member 206 and the second rigid member 208. The filter medium 214 includes a housing 218 with selected perforations 220 that allow hydrocarbon fluid to flow to a filter media 222 disposed within the housing 218. The filter media 222 can filter particulate materials from hydrocarbon fluid and direct the filtered hydrocarbon fluid to one or both openings 216 in the first and second rigid members 206, 208.

A second filter medium 221 is disposed exterior to the second swellable material 212 and part of the second rigid member 208. The second filter medium 220 may be constructed similar to the filter medium 214 and be configured to direct filtered hydrocarbon fluid to a second opening 223 in second rigid member 208 or to an opening in another rigid member (not shown).

Each of the openings 216 has a piston 224 disposed within it. Each of the pistons 224 can be coupled to the filter medium 214 and each of the pistons 224 can include a telescoping portion 226. The second opening 223 includes a second piston 228 that is constructed similar to pistons 224.

Upon contact with an activating fluid, the swellable material 210 and second swellable material 212 can expand radially to displace the filter medium 214 and second filter medium 220 to contact with the formation 205. Examples of the activating fluid include hydrocarbon fluid, water, and gas. The telescoping portion 226 of pistons 224 can extend radially from openings 216 to provide support to the filter medium 214 during the operating configuration and provide a conduit through which hydrocarbon fluid can flow from the filter media 222 through openings 216 to the internal flow path 203. The second piston 228 may perform similarly for the second filter medium 220 during the operating configuration.

FIGS. 7A and 7B illustrate rigid members located proximate to ends of filter mediums. In other embodiments, rigid members are located proximate to other portions of filter mediums. For example, a rigid member can support a filter medium proximate to a middle of the filter medium during a running configuration and include openings through which hydrocarbon fluid can flow from the filter medium to an internal flow path of a base pipe.

Figure 8:
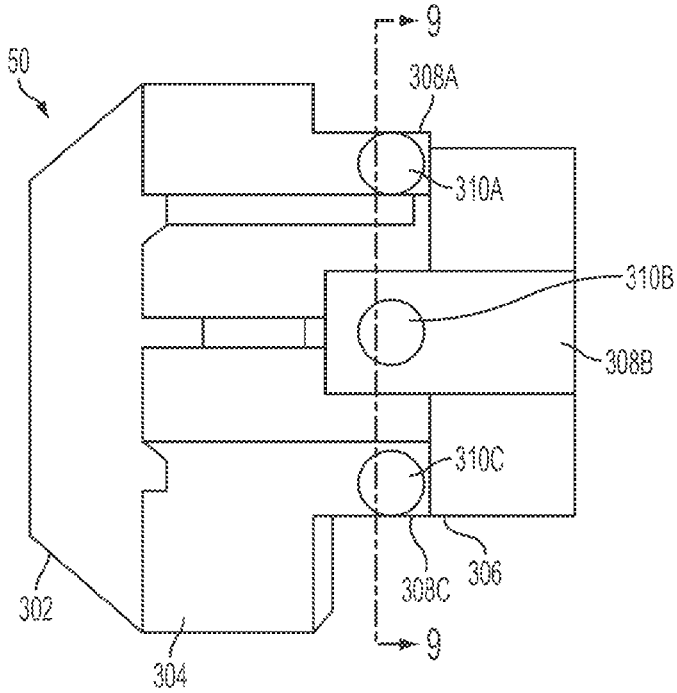
FIG. 8 is a side view of a rigid member capable of being included in a screen assembly according to one embodiment of the present invention.

Rigid members according to various embodiments of the present invention can be constructed using a variety of designs. FIG. 8 is a side view of one embodiment of the rigid member 50 from FIGS. 6A-6B. The rigid member 50 is a ring that can be located exterior to a portion of a base pipe. The rigid member 50 includes a sloped portion 302, an intervening portion 304, and a filter medium support portion 306. The sloped portion 302 has a sloping shape to prevent damage to the remaining portions of the rigid member 50 during installation of the rigid member 50 in a bore. The intervening portion 304 may connect the sloped portion 302 and the filter medium support portion 306 and provide stability to the rigid member 50 to reduce or prevent damage to filter mediums or other components of a screen assembly when installed in the wellbore.

The filter medium support portion 306 can provide support to filter mediums of the screen assembly. The filter medium support portion 306 includes receiving portions 308A-C. Each of the receiving portions 308-C includes a respective opening 310A-C and each of the receiving portions 308A-C can support a respective filter medium. For example, each of the receiving portions 308A-C may be grooves that can receive a filter medium in a running configuration and allow the filter medium to detach from the grooves during an operating configuration. The openings 310A-C can provide fluid communication to an internal flow path of a base pipe and can receive a piston for supporting the filter mediums during the running configuration and an operating configuration.

Figure 9:
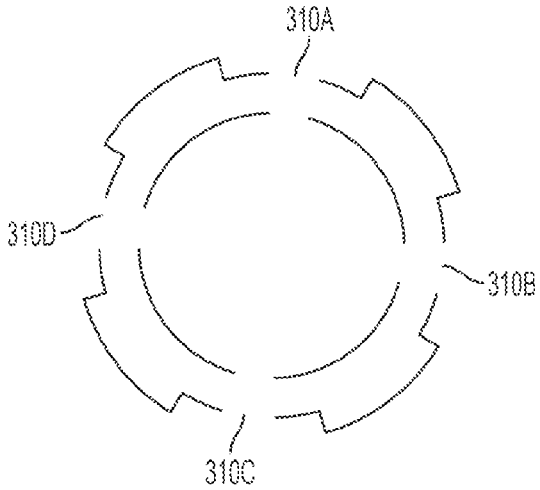
FIG. 9 is a cross section view along line 9-9 of the rigid member of FIG. 8 according to one embodiment of the present invention.

The receiving portions 308A-C can be staggered to support overlap of filter mediums and to define grooves. For example, FIG. 8 shows one receiving portion 308B having a different length than the other receiving portions 308A, 308C. FIG. 9 is a cross-sectional view of rigid member 300 along line 9-9. Openings 310A-D are shown in FIG. 9 as defined by grooves in filter medium support portion 306. A filter medium can be positioned over 310A and coupled to a piston disposed in opening 310A. Similarly, each of openings 310B-D can be associated with a respective filter medium.

The rigid member 50 may be made from a metal, composite polymer, non-swelling rubber, or the like. Examples of metals from which the rigid member 50 may be made include steel, iron, brass, copper, bronze, tungsten, titanium, cobalt, nickel, and a combination of these or other types of materials.

Screen assemblies according to some embodiments of the present invention can include multiple rigid members. For example, rigid member 50 can be located exterior to a first portion of a base pipe and a second rigid member can be located exterior to a second portion of the base pipe. Filter mediums can be located between the two rigid members. In some embodiments, rigid member 50 can support four filter mediums and the second rigid member can support four different filter mediums. FIG. 2 shows an example of a similar arrangement. The second rigid member can be rotated, for example by forty-five degrees relative to the rigid member 50, to align a receiving portion of the rigid member 50 that with a non-receiving portion of the second rigid member that has a greater cross-sectional radius. In this configuration, the filter mediums associated with the rigid member 50 and filter mediums associated with the second rigid member can be positioned adjacent to each other in an alternating arrangement.

Illustrative Swellable Material Compositions

Swellable material according to certain embodiments can be formed from one or more materials that swell upon contact with an activating fluid. For example, the swellable material may be a polymer that is capable of swelling to a size that is multiple times its initial size upon contact with an activating fluid that stimulates the material to expand. In some embodiments, the swellable material swells upon contact with an activating fluid that is a hydrocarbon fluid or a gas. The hydrocarbon fluid is absorbed by the swellable material and the absorption causes the volume of the swellable material to increase, thereby expanding radially. The swellable material may expand the filter mediums and part of the outer surface of the swellable material contacts a formation face in an open hole completion or a casing wall in a cased wellbore.

Some embodiments of the swellable material may be made from an elastic polymer. Examples of elastic polymers include ethylene propylene diene monomer (EPDM) rubber, styrene butadiene, natural rubber, ethylene propylene monomer rubber, ethylene vinyl acetate rubber, hydrogenized acrylonitrile butadiene rubber, acylonitrile butadiene rubber, isoprene rubber, chloroprene rubber and polynorbornene. The swellable material may also include other materials dissolved in, or in mechanical mixture, with the other materials that form the swellable material. Examples of other materials include fibers of cellulose, polyvinyl chloride, methyl methacrylate, acrylonitrile, ethylacetate, or other polymers.

In some embodiments, the swellable material is configured to expand upon contact with an activating fluid that is water. For example, the swellable material may be a water-swellable polymer such as a water-swellable elastomer or water-swellable rubber. More specifically, the swellable material may be a water-swellable hydrophobic polymer or water-swellable hydrophobic copolymer such as a water-swellable hydrophobic porous copolymer. Other polymers that can be used to form the swellable material include hydrophilic monomers and hydrophobically modified hydrophilic monomers. Examples of suitable hydrophilic monomers include acrylamide, 2-acrylamido-2methyl propane sulfonic acid, N,N-dimethylacrylamide, vinyl pyrrolidone, dimethylaminoethyl methacrylate, acrylic acid, trimethylammonium-ethyl, methacrylate chloride, dimethylaminopropyl-methacrylamide, methacrylamide, and hydroxyethyl acylate.

A variety of hydrophobically modified hydrophilic monomers can be utilized in accordance with certain embodiments. Examples of hydophobically modified hydrophilic monomers include alkyl acrylates, alkyl methacrylates, alkyl acrylamides, alkyl methacrylamides (where alkyl radicals have from about 4 to about 22 carbon atoms), alkyl dimethylammoniumethyl methacrylate chloride and alkyl dimethylammoniumethyl methacrylate iodide (where the alkyl radicals have from about 4 to about 22 carbon atoms), alkyl dimethylammonium-propylmethacrylamide bromide, alkyl dimethylammonium propylmethacrylamide chloride and alkyl dimethylammonium-propylmethacrylamide iodide (where the alkyl groups have from about 4 to about 22 carbon atoms).

Polymers suitable in swellable material according to certain embodiments can be prepared by polymerizing any one or more of the hydrophilic monomers with any one or more of the hydrophobically modified hydrophilic monomers. The polymerization reaction can be formed in various ways, an example of which is described in U.S. Pat. No. 6,476,169, which is incorporated herein by reference. These polymers may have estimated molecular weights in the range from about 100,000 to about 10,000,000, with a preferred range of 250,000 to about 3,000,000. These polymers may also have mole ratios of the hydrophilic monomer(s) to the hydrophobically modified hydrophilic monomer(s) in the range of from about 99.98:0.02 to about 90:10.

In some embodiments, the swellable material may be made from a salt polymer such as polyacrylamide or modified crosslinked poly(meth)acrylate that tends to attract water from salt water through osmosis. For example, when water that flows from an area of low salt concentration (the formation water) to an area of high salt concentration (a salt polymer), across a semi-permeable membrane (an interface between the salt polymer and production fluids), the salt polymer allows water molecules to pass, but prevents passage of dissolved salts.

The foregoing description of the embodiments, including illustrated embodiments, of the invention has been presented only for the purpose of illustration and description and is not intended to be exhaustive or to limit the invention to the precise forms disclosed. Numerous modifications, adaptations, and uses thereof will be apparent to those skilled in the art without departing from the scope of this invention.

What is claimed is:

1. A screen assembly capable of being disposed in a bore, the screen assembly comprising:

a base pipe comprising a sidewall portion having an opening therein;

a rigid member circumferentially surrounding a first portion of the base pipe, the rigid member comprising an opening in fluid communication with the opening of the base pipe;

a swellable material disposed exterior to a second portion of the base pipe;

a filter medium at least partially disposed exterior to the swellable material, the filter medium being in fluid communication with the opening of the rigid member; and a non-swelling material configured for providing a temporary seal between the filter medium and the rigid member.

2. The screen assembly of claim 1, wherein, in response to contact with an activating fluid, the swellable material is configured for expanding and displacing at least part of the filter medium toward a surface of the bore.

3. The screen assembly of claim 1, further comprising:

a piston disposed in the opening of the rigid member and coupled to the base pipe, wherein the piston comprises an extendable telescoping portion coupled to the filter medium, wherein the filter medium is configured for filtering fluids and directing the fluids to an internal flow path of the base pipe through the piston.

4. The screen assembly of claim 1, wherein the material comprises rubber.

5. The screen assembly of claim 1, wherein the filter medium has a kidney-shaped cross-section.

6. The screen assembly of claim 1, wherein the rigid member is a ring that is at least one of:

a metal;

a composite polymer; or a non-swelling rubber compound.

7. A screen assembly capable of being disposed in a bore, the screen assembly comprising:

a base pipe comprising a sidewall portion having a plurality of openings therein;

a ring exterior to a first portion of the base pipe, the ring comprising at least one opening configured for being in fluid communication with an opening of the plurality of openings of the sidewall portion;

a swellable material disposed exterior to a second portion of the base pipe that is different than the first portion of the base pipe; and a filter medium at least partially disposed exterior to the swellable material and configured for being in fluid communication with the at least one opening of the ring.

8. The screen assembly of claim 7, wherein, in response to contact with an activating fluid, the swellable material is configured for expanding and displacing at least part of each of the plurality of filter mediums toward a surface of the bore.

9. The screen assembly of claim 8, wherein the activating fluid is at least one of a hydrocarbon fluid, water, or a gas.

10. The screen assembly of claim 7, wherein the filter medium has a kidney-shaped cross-section.

11. The screen assembly of claim 7, wherein the ring is at least one of:

a metal;

a composite polymer; or a non-swelling rubber compound.

12. A screen assembly capable of being disposed in a bore, the screen assembly comprising:

a base pipe comprising a first opening in a first portion of the base pipe and a second opening in a second portion of the base pipe;

a first rigid member exterior to the first portion of the base pipe;

a second rigid member exterior to the second portion of the base pipe;

a swellable material exterior to a third portion of the base pipe that is between the first portion and the second portion; and a plurality of filter mediums at least partially disposed exterior to the swellable material, each of the plurality of filter mediums being in fluid communication with at least one of the first opening or the second opening.

13. The screen assembly of claim 12, wherein, in response to contact with an activating fluid, the swellable material is configured for expanding and displacing at least part of each of the plurality of filter mediums toward a surface of the bore.

14. The screen assembly of claim 12, wherein the first rigid member is a first ring circumferentially surrounding the first portion of the base pipe.

15. The screen assembly of claim 14, wherein the second rigid member is a second ring circumferentially surrounding the second portion of the base pipe.

16. The screen assembly of 12, wherein each of the first rigid member and the second rigid member comprise:

a first receiving portion for supporting a first filter medium of the plurality of filter mediums in a running configuration; and a second receiving portion for supporting a second filter medium of the plurality of filter mediums in the running configuration.

17. The screen assembly of 16, wherein the first receiving portion and the second receiving portion define grooves for supporting the first filter medium and the second filter medium of the plurality of filter mediums in the running configuration.

18. The screen assembly of claim 17, wherein the second rigid member is rotated forty-five degrees relative to the first rigid member, wherein the first receiving portion of the first rigid member is aligned with the second receiving portion of the second rigid member.

19. The screen assembly of claim 12, wherein at least part of each of the plurality of filter mediums is exterior to the first rigid member or the second rigid member.

* * * * *